US006405561B1

(12) United States Patent
Mortko et al.

(10) Patent No.: US 6,405,561 B1
(45) Date of Patent: Jun. 18, 2002

(54) GAS SEPARATION PROCESS

(75) Inventors: Robert A. Mortko; Kevin L. Currence, both of Olathe, KS (US)

(73) Assignee: Black & Veatch Pritchard, Inc., Overland Park, KS (US)

( * ) Notice: Subject to any disclaimer, the term of this patent is extended or adjusted under 35 U.S.C. 154(b) by 0 days.

(21) Appl. No.: 09/875,308

(22) Filed: Jun. 6, 2001

Related U.S. Application Data

(60) Provisional application No. 60/291,079, filed on May 15, 2001.

(51) Int. Cl.[7] ..... F25J 3/02
(52) U.S. Cl. ..... 62/631
(58) Field of Search ..... 62/630, 631

(56) References Cited

U.S. PATENT DOCUMENTS

| | | | | |
|---|---|---|---|---|
| 2,769,321 A | * | 11/1956 | Stiles | 62/631 |
| 2,777,305 A | * | 1/1957 | Davison | 62/631 |
| 4,690,702 A | * | 9/1987 | Paradowski et al. | 62/630 |
| 5,588,308 A | * | 12/1996 | Daugherty et al. | 62/630 |
| 5,771,715 A | * | 6/1998 | Campbell et al. | 62/621 |

* cited by examiner

*Primary Examiner*—Ronald Capossela
(74) *Attorney, Agent, or Firm*—F. Lindsey Scott

(57) ABSTRACT

A process for separating a feed gas stream containing methane, $C_2$ components, $C_3$ components, and heavier components into a volatile gas stream containing a major portion of the methane and $C_2$ components and a less volatile stream containing a major portion of the $C_3$ and heavier components by adjusting the temperature and pressure of the feed gas stream and charging it to a separator/absorber where the gas stream is separated into a first gas stream containing a major portion of the methane and $C_2$ components with a minor content of $C_3$ and heavier components and a first liquid stream containing a major portion of the $C_3$ and heavier components with a lesser concentration of $C_2$ and lighter components with the first liquid stream being fractionated in a deethanizer into an overhead stream and a bottoms stream with the bottoms stream containing primarily $C_3$ and heavier components with the overhead stream containing primarily $C_2$ and lighter components being at least partially condensed and separated into a liquid reflux stream, a second liquid stream and a vaporous stream. The second liquid stream is passed to an upper portion of the separator/absorber for use therein to absorb $C_3$ and heavier components from a gas stream in the separator/absorber.

19 Claims, 3 Drawing Sheets

GAS SEPARATION PROCESS

RELATED APPLICATION

This application is entitled to and hereby claims the benefit of the filing date of a provisional application entitled "Gas Separation Process" Ser. No.: 60/291,079, filed May 15, 2001 by Robert A. Mortko and Kevin L. Currence.

FIELD OF THE INVENTION

This invention relates to a process for the recovery of $C_3$ and heavier components from a natural gas stream or refinery gas stream.

BACKGROUND OF THE INVENTION

It is well known that natural gas streams can be separated into their component parts. Such processes involve a combination of chilling, expansion, distillation and/or like operations to separate methane and ethane from $C_3$ and heavier hydrocarbon components. Typically the separation made is of methane and ethane from propane and heavier components. If economically desirable, the ethane could also be recovered and similarly, it is desirable in many instances to further fractionate the recovered $C_3$ (or alternatively $C_2$) and heavier components. Such variations are well known to those skilled in the art.

One such process is shown in U.S. Pat. No. 5,771,712 entitled "Hydrocarbon Gas Processing" issued Jun. 30, 1998, to Roy E. Campbell, John D. Wilkinsun and Hank M. Hudson. (the '712 Patent) This patent is hereby incorporated in its entirety by reference.

The '712 Patent demonstrates a typical process wherein an overhead stream from a deethanizer is passed into heat exchange with an exit stream from an absorber to cool the overhead stream from the deethanizer to a temperature at which it is partially liquefied. This partially liquefied stream is then introduced into the absorber wherein the liquid portion of the stream passes downwardly through the absorber to contact a gaseous stream passing upwardly through the absorber. While this processing system has been effective to separate $C_2$ and lighter components from $C_3$ and heavier components, it is relatively inefficient when processing lower pressure feed gas streams. It is also relatively inefficient when processing rich feed gas streams with respect to their $C_3$ and heavier content. It is particularly ineffective when large amounts of very light gases, such as hydrogen, may be present in the feed gas stream charged to the process. Hydrogen in gaseous streams recovered from refinery operations, which may be desirably separated in such processes, is not uncommon. While the occurrence of hydrogen in significant quantities in natural gas is rare, the presence of hydrogen in similar streams from refinery operations is common.

Accordingly, it is desirable that a more efficient and a more effective method be available for the separation of $C_3$ and heavier components from such refinery streams. It is also desirable that a more efficient and more effective method be available for the processing of natural gas streams.

SUMMARY OF THE INVENTION

According to the present invention, a more efficient and effective process is provided.

The invention comprises an improvement in a process for separating a feed gas stream containing methane, $C_2$ components, $C_3$ components and heavier components into a volatile gas stream containing a major portion of the methane and $C_2$ components and a less volatile stream containing a major portion of the $C_3$ and heavier components by adjusting the temperature and pressure of the feed gas stream to a suitable temperature for separation into an absorber gas stream and a first liquid stream in a separator/absorber with the absorber gas stream containing a major portion of the methane and $C_2$ components and the first liquid stream containing a major portion of the $C_3$ and heavier components, the first liquid stream being charged to a deethanizer from which a bottoms liquid product comprising primarily the $C_3$ and heavier components is recovered with the deethanizer overhead consisting primarily of $C_2$ and lighter components, the improvement comprising:

a) cooling the deethanizer overhead to produce a partially condensed stream;

b) separating the cooled deethanizer overhead stream into a liquid stream comprising principally $C_2$ components and a residue gas stream; and, c) cooling a portion of the liquid stream by heat exchange with the absorber gas stream to produce a subcooled liquid stream and passing the subcooled liquid stream to an upper portion of the separator/absorber for contact with a gas stream rising through the separator/absorber to absorb $C_3$ and heavier components therefrom.

The invention further comprises a process for separating a feed gas stream containing methane, $C_2$ components, $C_3$ components and heavier components into a volatile gas stream containing a major portion of the methane and $C_2$ components and a less volatile stream containing a major portion of the $C_3$ and heavier components, the process comprising:

a) cooling the feed gas stream to a temperature sufficient to condense the majority of the $C_3$ components in the feed gas stream by heat exchange with at least one of a first liquid stream containing $C_3$ and heavier components and a refrigerant stream to produce a cooled feed gas stream;

b) passing the cooled feed gas stream to a separator/absorber to produce the first liquid stream as a bottoms product and a separator/absorber overhead residue gas stream;

c) passing the first liquid stream to a deethanizer tower operating at a pressure at least 25 psi (pounds per square inch) above the pressure in the separator/absorber;

d) separating the first liquid stream into a deethanizer bottoms stream containing a majority of the $C_3$ and heavier components and a deethanizer overhead gas stream;

e) cooling the deethanizer overhead gas stream to partially condense the deethanizer overhead gas stream by heat exchange with a refrigerant stream to produce a deethanizer liquid reflux stream, a second liquid stream and a deethanizer residue gas stream; and, f) cooling the second liquid stream by heat exchange with the separator/absorber overhead residue gas stream to produce a subcooled second liquid stream and passing the subcooled second liquid stream into an upper portion of the separator/absorber.

The invention further comprises a process for separating a feed gas stream containing methane, $C_2$ components, $C_3$ components and heavier components into a volatile gas stream containing a major portion of the methane and $C_2$ components and a less volatile stream containing a major portion of the $C_3$ and heavier components, the process comprising:

a) cooling the feed gas stream to a temperature sufficient to condense the majority of the $C_3$ components in the feed gas stream by heat exchange with at least one of a first liquid stream containing $C_3$ and heavier components, a second liquid stream containing $C_3$ and heavier components, a residue gas stream, and a refrigerant stream to produce a cooled feed gas stream;

b) passing the cooled feed gas stream to a separator to produce a separator gas stream and the first liquid stream;

c) optionally further cooling the separator gas stream by heat exchange or expansion and passing it to a separator/absorber wherein a second liquid stream is produced as a bottoms stream and wherein a separator/absorber overhead residue gas stream is produced;

d) passing the first liquid stream and the second liquid stream to a deethanizer tower operating at a pressure at least 25 psi above the separator/absorber pressure;

e) separating the first and the second liquid streams into a deethanizer bottoms stream containing a majority of the $C_3$ and heavier components and a deethanizer overhead gas stream;

f) cooling the deethanizer overhead gas stream to partially condense the deethanizer overhead gas stream by heat exchange with a refrigerant stream to produce a deethanizer liquid reflux stream, a third liquid stream and a deethanizer residue gas stream; and, g) cooling the third liquid stream by heat exchange with the separator/absorber overhead residue gas stream to produce a subcooled third liquid stream and passing the subcooled third liquid stream into an upper portion of the separator/absorber.

The invention further comprises a process for separating a feed gas stream containing methane, $C_2$ components, $C_3$ components and heavier components into a volatile gas stream containing a major portion of the methane and $C_2$ components and a less volatile stream containing a major portion of the $C_3$ and heavier components, the process comprising:

a) cooling the feed gas stream to a temperature sufficient to condense the majority of the $C_3$ components in the feed gas stream by heat exchange with at least one of a first liquid stream containing $C_3$ and heavier components, a second liquid stream containing $C_3$ and heavier components, a residue gas stream, and a refrigerant stream to produce a cooled feed gas stream;

b) passing the cooled gas stream to a first separator to produce a first separator gas stream and a first separator liquid stream;

c) optionally further cooling the first separator gas stream by heat exchange or expansion and passing it to a separator/absorber wherein the second liquid stream is produced as a bottoms stream and wherein a separator/absorber overhead residue gas stream is produced;

d) passing the first separator liquid stream to a second separator at a lower pressure than the first separator and separating a second separator residue gas stream and a second separator liquid stream;

e) passing the first separator liquid stream and the second separator liquid stream to a deethanizer tower operating at a pressure at least 25 psi above the separator/absorber pressure;

f) separating the first and the second separator liquid streams into a deethanizer bottoms stream containing a majority of the $C_3$ and heavier components and a deethanizer overhead gas stream;

g) cooling the deethanizer overhead gas stream to partially condense the deethanizer overhead gas stream by heat exchange with a refrigerant stream to produce a deethanizer liquid reflux stream, a third liquid stream and a deethanizer residue gas stream; and, j) cooling the third liquid stream by heat exchange with the separator/absorber overhead residue gas stream to produce a subcooled third liquid stream and passing the subcooled third liquid stream into an upper portion of the separator/absorber.

DESCRIPTION OF THE PREFERRED EMBODIMENTS

In the description of the Figures, the same numbers will be used throughout to refer to the same or similar components. For conciseness no attempt is made to include all pumps, valves and the like necessary to achieve the indicated stream flows.

Figure 1:
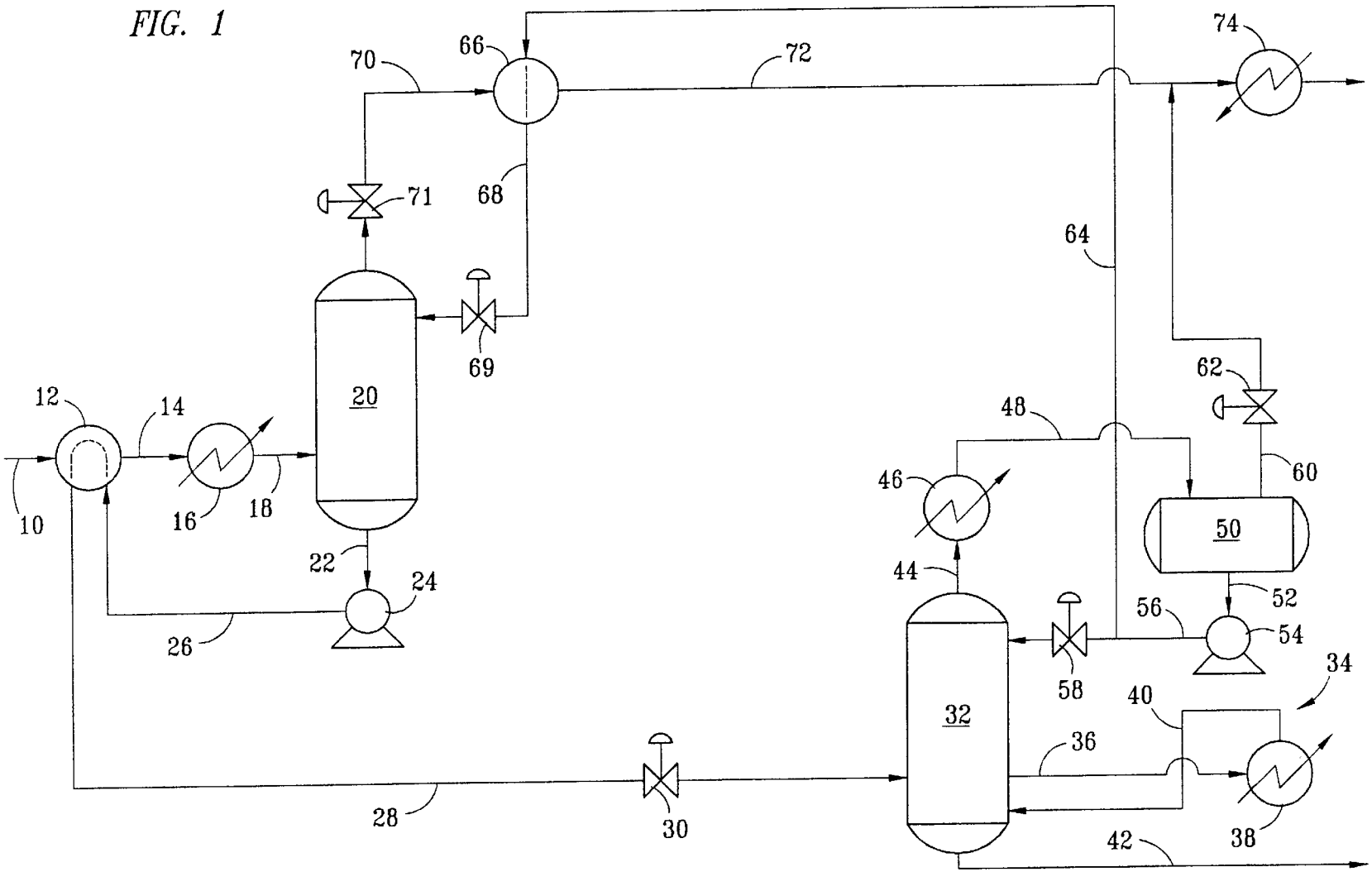
FIG. 1 is a schematic diagram of an embodiment of the present invention.

In FIG. 1, an embodiment of the present invention is shown which is particularly effective for the treatment of refinery streams containing substantial amounts, i.e., up to or more than twenty mole percent hydrogen. In the process of claim 1, the inlet gas stream is charged to the process via a line 10. The inlet feed gas is cooled in a heat exchanger 12 and thereafter passed via a line 14 to a heat exchanger 16 where it is further cooled to a selected temperature and passed to a separator/absorber 20 (sometimes referred to as an absorber) containing one or more theoretical stages of mass transfer. In separator/absorber 20, a liquid bottoms stream comprising primarily $C_3$ and heavier components plus some light components is recovered via a line 22 and a pump 24 and pumped via a line 26 to heat exchanger 12 where it is used to cool the inlet gas stream in line 10. The stream in line 26 is then passed via a line 28 and a valve 30 to a deethanizer 32. In deethanizer 32 the stream from line 28 is separated by conventional distillation techniques as well known to the art for deethanizers into an overhead vapor stream 44 and a bottoms stream 42. A conventional reboiler 34 is shown. Reboiler 34 comprises an outlet line 36 near the bottom of deethanizer 32 which passes a stream to a heat exchanger 38 where it is heated and passed via a line 40 back to a lower portion of deethanizer 32. The stream recovered from deethanizer 32 through line 42 comprises primarily $C_3$ and heavier components. An overhead stream is recovered from the deethanizer via line 44, which is rich in $C_2$ and lighter components and is passed to a heat exchanger 46 where it is partially condensed and then through a line 48 to a separator 50. From separator 50, a liquid stream is withdrawn via a line 52 and passed to a pump 54 from which a portion of the liquid stream is passed via a line 56 and a valve 58 into an upper portion of deethanizer 32 as a reflux. The vapor stream recovered from separator 50 is passed via a line 60 and a valve 62 to combination with another stream in a line 72 comprising $C_2$ and lighter components.

A second portion of the liquid stream from separator 50 is passed via a line 64, a heat exchanger 66, a line 68 and a valve 69 into an upper portion of separator/absorber 20. An overhead vapor stream recovered from the upper portion of absorber 20 is passed via a line 70, a valve 71, heat exchanger 66 and a line 72 to combination with the stream in line 60. The combined stream contains a major portion of the $C_2$ and lighter components from the inlet gas feed stream. This stream is desirably warmed in a heat exchanger 74 to a selected temperature for discharge as a product stream. Final residue gas compression may be used as required.

In the operation of the process as described above, the $C_2$ and lighter stream produced through line 44 is cooled, partially condensed and passed to separator 50 where a liquid stream comprising primarily ethane is recovered and is partially used as a reflux to deethanizer 32. A second portion of this liquid stream is passed via a line 64 through heat exchanger 66, wherein the second portion is subcooled and passed to the upper portion of separator/absorber 20. In separator/absorber 20, the total inlet gas stream is available for separation. In this separator/absorber it is desirable that the $C_3$ and heavier components be separated for recovery. A simple flashing operation in this vessel typically results in a carryover of unacceptably high levels of $C_3$ and heavier components.

By existing processes such as shown in U.S. Pat. No. 5,771,712, the gas exiting the deethanizer overhead in stream 44 is cooled and partially condensed using the absorber overhead vapor stream. This requires the absorber to operate at a lower pressure to provide for this additional chilling requirement which typically increases the amount of required residue gas recompression horsepower. By the present invention, the gas exiting the deethanizer overhead in stream 44 is cooled and partially condensed using mechanical refrigeration. Stream 64 is then subcooled by heat exchange against the absorber overhead vapor. By comparison this is as much as 25% more efficient when comparing total refrigeration plus residue gas compression horsepower requirements.

Further, in the process disclosed, the refrigerant used in heat exchangers 16 and 46 is separately produced in a unit such as a common propane refrigeration unit. Proper selection of separator/absorber and deethanizer operating conditions permits the same refrigerant temperature level to be efficiently used in both heat exchangers 16 and 46.

In an illustrative embodiment of the process of FIG. 1, a refinery gas stream at 110° F. and 215 psia is charged to the process. In heat exchanger 12, this stream is cooled to 52° F. and subsequently cooled to a temperature of −24° F. using a propane refrigerant at −30° F. in heat exchanger 16. This stream is then charged to separator/absorber 20 from which a bottoms stream at −31° F. and 205 psia comprising a major portion of the $C_3$ and heavier components in the inlet gas stream is recovered. This stream is passed via pump 24 in heat exchange relationship with the inlet feed gas stream in heat exchanger 12 and then passed at 100° F. to the deethanizer.

The overhead stream recovered from separator/absorber 20 is at −95° F. and 200 psia. This stream is then passed through an expansion valve 71 to produce a stream at −102° F. and 89 psia. This stream passes in heat exchange relationship with a liquid stream containing primarily $C_2$ components in heat exchanger 66. The resulting subcooled liquid stream is at a temperature of −95° F. as introduced into the upper portion of separator/absorber 20 via line 68 and valve 69. This results in placing a liquid stream of ethane in the top portion of separator/absorber 20, where it flows downwardly through separator/absorber 20 thereby absorbing $C_3$ and heavier components from the upwardly rising gaseous stream. Both separator/absorber 20 and deethanizer 32 are designed to provide an effective distillation equal to a selected number of theoretical trays to achieve the desired contact and separation. Such variations are well known to those skilled in the art.

The overhead stream recovered from deethanizer 32 is at a temperature of 39° F. and 445 psia. This stream is cooled in heat exchange 46 using a propane refrigerant at −30° F. and then passed to separator 50 from which a gaseous stream is recovered via a line 60 at −24° F. It will be noted that in the operation of this system, the pressure of the deethanizer is at a pressure at least about 25 psi, preferably up to about 100 psi and may be up to about 200 psi higher than the pressure of the separator/absorber. The temperatures and pressures of these two vessels can readily be adjusted to require a refrigerant at the same temperature level. In the embodiment discussed, a liquid propane refrigerant at −30° F. is used for both heat exchangers 16 and 46. A separate refrigeration unit is used to produce refrigerant for use in these two heat exchangers.

Figure 2:
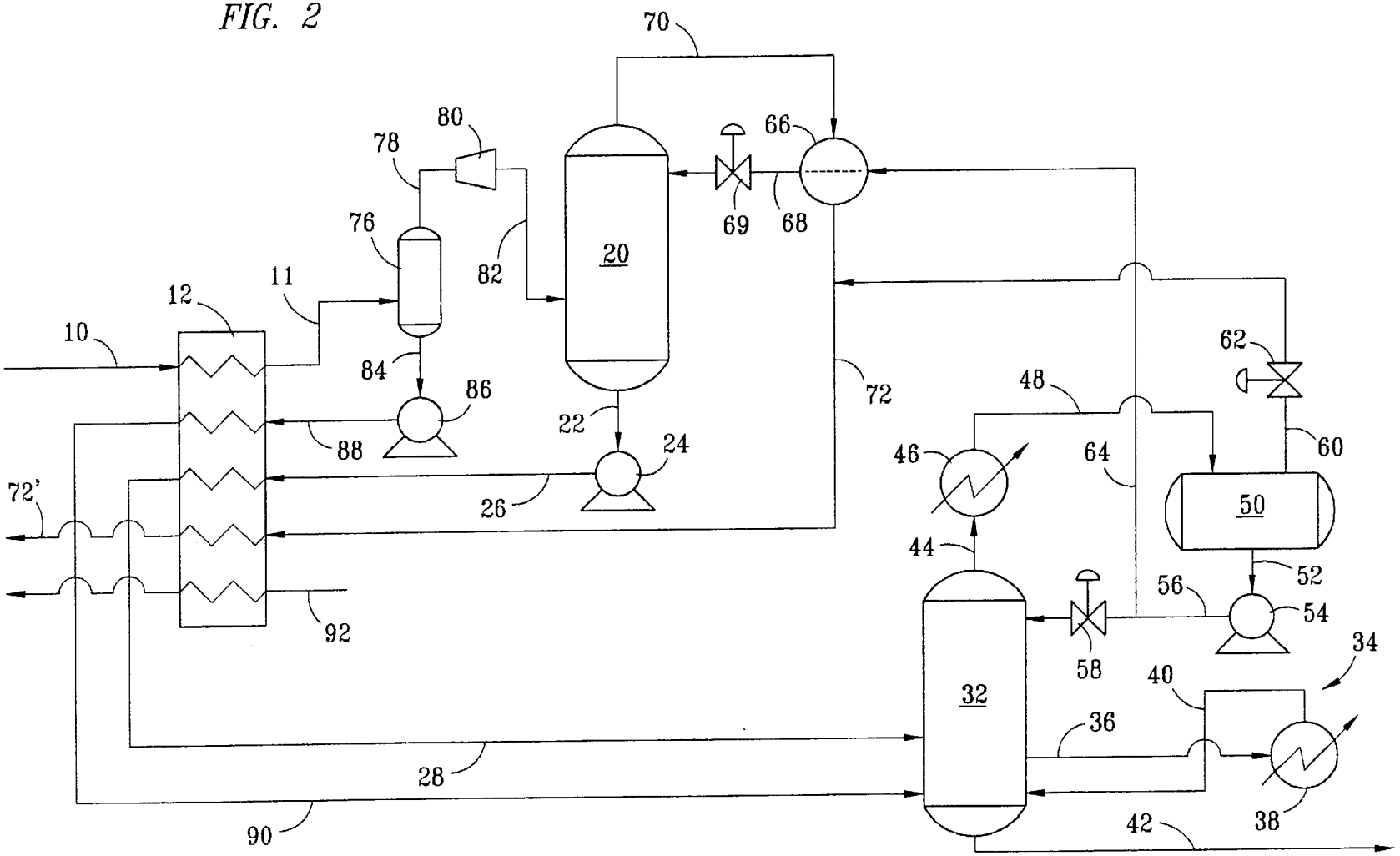
FIG. 2 is a schematic diagram of an alternate embodiment of the present invention; and, FIG. 3 is a schematic diagram of a still further embodiment of the process of the present invention.

In FIG. 2, an alternate embodiment of the present invention is shown and is adapted to the recovery of $C_3$ and heavier components from a higher pressure natural gas stream. In this embodiment, the inlet feed gas stream 10 is passed through a heat exchanger 12 where it is heat exchanged with at least one of a residue or $C_2$ and lighter component containing stream in line 72, a liquid stream containing primarily $C_3$ and heavier components recovered through a line 26 from separator/absorber 20 and a stream containing primarily $C_3$ and heavier components recovered through a line 88. Additional heat exchange, as required, is supplied by the use of propane or another suitable refrigerant in a heat exchanger portion shown by line 92. It will be understood that the heat exchange function shown schematically in heat exchanger 12 may be accomplished in a single or a plurality of heat exchange vessels.

In this embodiment, the inlet gas is passed via a line 11 to a separation vessel 76 where it is separated into a vapor stream 78 which is further expanded in an expander 80 and passed via a line 82 to separator/absorber 20. The bottoms stream recovered from vessel 76 is a liquid stream containing primarily $C_3$ and heavier components, although both the stream in line 84 and in line 22 will contain quantities of lighter materials. The stream recovered via line 88 and the stream recovered via line 26 are passed to deethanizer 32 for separation. In other respects, the process is as described previously.

In an illustrative embodiment of the process shown in FIG. 2, a gas stream is charged to the process at 100° F. at 422 psia. The gas stream is cooled in heat exchanger 12 to a temperature of −69° F. and 417 psia and charged to separation vessel 76. In separation vessel 76, a gaseous stream is produced and passed to expander 80 from which it is passed at −93° F. at 295 psia to separator/absorber 20. The liquid stream recovered via line 84 is passed through heat exchanger 12 and then to deethanizer 32 via line 90 at a temperature of 65° F. The liquid stream recovered from absorber 20 is at a temperature of −93° F. at 295 psia. This stream is passed via line 26 to heat exchanger 12 and then via line 28 to deethanizer 32 at a temperature of 25° F. In deethanizer 32, a bottoms liquid stream composed primarily of $C_3$ and heavier components is recovered via a line 42 at a temperature of 210° F. at 450 psia. The vapor stream recovered from line 60 is at a temperature of −39° F. at 440 psia. This stream may be expanded to a lower temperature and pressure, for instance, to −59° F. at 285 psia. This adjustment is made to adjust the pressure of the stream in line 60 to the pressure of the stream in line 72. The liquid stream recovered from separator 50 and passed to absorber 20 via heat exchanger 66 and line 68, is at a temperature of about −97° F. The overhead stream recovered from absorber 20 is at a temperature of −102° F. at 290 psia. This stream, after heat exchanger in exchanger 66, is at a temperature of about −98° F. at 285 psia. Again, in both these embodiments the same temperature propane or other refrigerant may be used in heat exchangers 12 and 46. In this embodiment, the refrigerant is at a temperature of −44° F.

In all the embodiments shown, steam is used as a heat supply in reboiler 34. Other streams could be used, but steam is conveniently used for this purpose.

Figure 3:
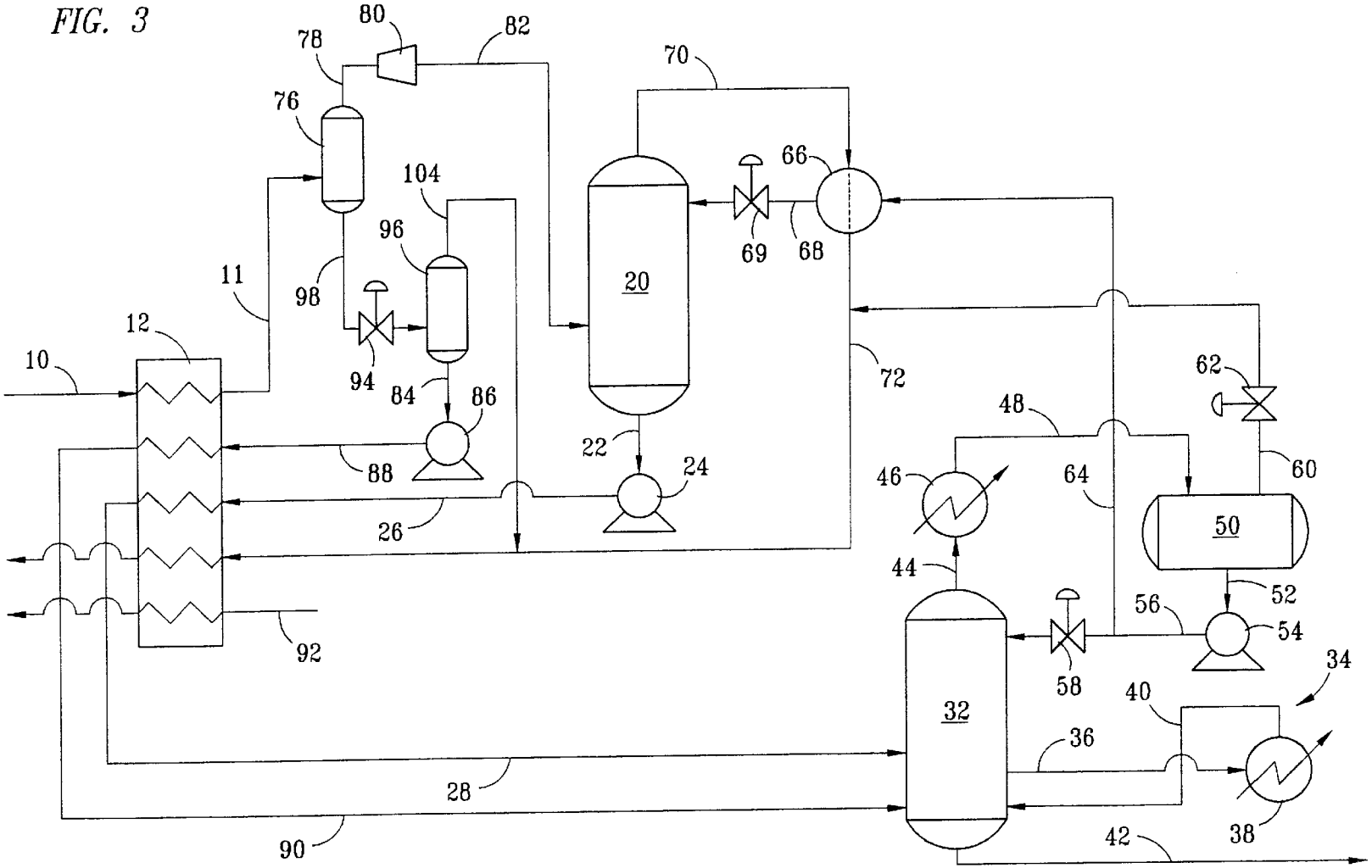

In FIG. 3, a further embodiment of the present invention is shown. In this embodiment, which is suited to higher pressure feed gas, the feed gas charged through line 10 is cooled in heat exchanger 12 and passed via a line 11 to a separator vessel 76. In separator vessel 76, a vaporous stream is recovered through a line 78 and subsequently passed through an expander 80 and a line 82 into separator/absorber 20. A bottoms stream recovered from separator vessel 76 via a line 98 and a valve 94 is passed to a flash vessel 96. In flash vessel 96, a liquid stream 84 is recovered and passed via a pump 86 and a line 88 through heat exchanger 12 and then via a line 90 to deethanizer 32. The remaining light components of this stream are separated in flash vessel 96 with the vaporous overhead stream being passed via a line 104 to combination with the residual $C_2$ and lighter gaseous components separated in the process. This stream is combined with the stream in line 72. The bottoms stream, which comprises primarily $C_3$ and heavier components, is passed as previously described to deethanizer 32. In other respects, the process shown in FIG. 3 operates in a similar fashion to the processes described in FIGS. 1 and 2.

In the practice of the present invention, the method and apparatus described above are comparatively more efficient than processes such as shown in U.S. Pat. No. 5,771,712. The use of refrigerant in heat exchanger 46 has been demonstrated to be a more efficient method of producing the required absorber upper feed "lean oil" steam. Subcooling of this stream by heat exchange with the absorber overhead vapor stream further improves efficiency.

As mentioned previously, the embodiments of this invention are most effective when processing lower pressure feed streams, feed streams rich with respect to recoverable $C_3$ and heavier components, and/or where large quantities of very light components (including hydrogen) are present in the feed gas. Accordingly, the process of the present invention provides greatly increased efficiency and the flexibility to handle gaseous feed streams which contain large quantities of non-condensable gas, such as hydrogen. The present process permits very high recovery of $C_3$ and heavier components from such streams. Not only is the apparatus and process disclosed above more efficient and flexible with respect to the feed stream than existing processes, it also provides for improved recovery.

While specific temperatures have been referred to in connection with the respective Figures, it should be understood that a wide range of temperature and pressure variations are possible within the scope of the present invention. Such temperature and pressure variations are readily determined by those skilled in the art based upon the composition of the specific feed streams, the desired recoveries and the like within the scope of the processes disclosed above.

While the present invention has been described by reference to certain of its preferred embodiments, it is respectfully pointed out that the embodiments described are illustrative rather than limiting in nature and that many variations and modifications are possible within the scope of the present invention. Many such variations and modifications may be considered obvious and desirable by those skilled in the art based upon a review of the foregoing description of preferred embodiments.

Having thus described the invention, we claim:

1. In a process for separating a feed gas stream containing methane, $C_2$ components, $C_3$ components and heavier components into a volatile gas stream containing a major portion of the methane and $C_2$ components and a less volatile stream containing a major portion of the $C_3$ and heavier components by adjusting the temperature and pressure of the feed gas stream to a suitable temperature for separation into an absorber gas stream and a first liquid stream in a separator/absorber with the absorber gas stream containing a major portion of the methane and $C_2$ components and the first liquid stream containing a major portion of the $C_3$ and heavier components, the first liquid stream being charged to a deethanizer from which a bottoms liquid product comprising primarily the $C_3$ and heavier components is recovered with the deethanizer overhead consisting primarily of $C_2$ and lighter components, the improvement comprising:

a) cooling the deethanizer overhead to produce a partially condensed stream;

b) separating the cooled deethanizer overhead stream into a liquid stream comprising principally $C_2$ components and a residue gas stream; and, c) cooling a portion of the liquid stream in heat exchange with the absorber gas stream to produce a subcooled liquid stream and passing the subcooled liquid stream to an upper portion of the separator/absorber for contact with a gas stream rising through the separator/absorber to absorb $C_3$ and heavier components therefrom.

2. The improvement of claim 1 wherein a pressure in the deethanizer is at least 25 psi greater than a pressure in the separator/absorber.

3. The improvement of claim 1 wherein the pressure in the deethanizer is at least 100 psi greater than the pressure in the separator/absorber.

4. The process of claim 1 wherein the separator/absorber contains at least one theoretical stage of mass transfer.

5. A process for separating a feed gas stream containing methane, $C_2$ components, $C_3$ components and heavier components into a volatile gas stream containing a major portion of the methane and $C_2$ components and a less volatile stream containing a major portion of the $C_3$ and heavier components, the process comprising:

a) cooling the feed gas stream to a temperature sufficient to condense the majority of the $C_3$ components in the feed gas stream by heat exchange with at least one of a first liquid stream containing $C_3$ and heavier components and a refrigerant stream to produce a cooled feed gas stream;

b) passing the cooled feed gas stream to a separator/absorber to produce the first liquid stream as a bottoms product and a separator/absorber overhead residue gas stream;

c) passing the first liquid stream to a deethanizer tower operating at a pressure at least 25 psi above the pressure in the separator/absorber;

d) separating the first liquid stream into a deethanizer bottoms stream containing a majority of the $C_3$ and heavier components and a deethanizer overhead gas stream;

e) cooling the deethanizer overhead gas stream to partially condense the deethanizer overhead gas stream by heat exchange with a refrigerant stream to produce a deethanizer liquid reflux stream, a second liquid stream and a deethanizer residue gas stream; and, f) cooling the second liquid stream by heat exchange with the separator/absorber overhead residue gas stream to produce a subcooled second liquid stream and passing the subcooled second liquid stream into an upper portion of the separator/absorber.

6. The process of claim 5 wherein the refrigerant comprises propane.

7. The process of claim 5 where the pressure of the deethanizer is at least 100 psi greater than the pressure in the separator/absorber.

8. The process of claim 5 wherein the pressure in the deethanizer is at least about 200 psi greater than the pressure in the separator/absorber.

9. The process of claim 5 wherein the separator/absorber contains at least one theoretical stage of mass transfer.

10. A process for separating a feed gas stream containing methane, $C_2$ components, $C_3$ components and heavier components into a volatile gas stream containing a major portion of the methane and $C_2$ components and a less volatile stream containing a major portion of the $C_3$ and heavier components, the process comprising:

a) cooling the feed gas stream to a temperature sufficient to condense the majority of the $C_3$ components in the feed gas stream by heat exchange with at least one of a first liquid stream containing $C_3$ and heavier components, a second liquid stream containing $C_3$ and heavier components, a residue gas stream, and a refrigerant stream to produce a cooled feed gas stream;

b) passing the cooled feed gas stream to a separator to produce a separator gas stream and the first liquid stream;

c) optionally further cooling the separator gas stream by heat exchange or expansion and passing it to a separator/absorber wherein a second liquid stream is produced as a bottoms stream and wherein a separator/absorber overhead residue gas stream is produced;

d) passing the first liquid stream and the second liquid stream to a deethanizer tower operating at a pressure at least 25 psi above the separator/absorber pressure;

e) separating the first and the second liquid streams into a deethanizer bottoms stream containing a majority of the $C_3$ and heavier components and a deethanizer overhead gas stream;

f) cooling the deethanizer overhead gas stream to partially condense the deethanizer overhead gas stream by heat exchange with a refrigerant stream to produce a deethanizer liquid reflux stream, a third liquid stream and a deethanizer residue gas stream; and, g) cooling the third liquid stream by heat exchange with the separator/absorber overhead residue gas stream to produce a subcooled third liquid stream and passing the subcooled third liquid stream into an upper portion of the separator/absorber.

11. The process of claim 10 wherein the refrigerant comprises propane.

12. The process of claim 10 wherein the pressure of the deethanizer is at least 100 psi greater than the pressure in the separator/absorber.

13. The process of claim 10 wherein the pressure of the deethanizer is at least 200 psi greater than the pressure in the separator/absorber.

14. The process of claim 10 wherein the separator/absorber contains at least one theoretical stage of mass transfer.

15. A process for separating a feed gas stream containing methane, $C_2$ components, $C_3$ components and heavier components into a volatile gas stream containing a major portion of the methane and $C_2$ components and a less volatile stream containing a major portion of the $C_3$ and heavier components, the process comprising:

a) cooling the feed gas stream to a temperature sufficient to condense the majority of the $C_3$ components in the feed gas stream by heat exchange with at least one of a first liquid stream containing $C_3$ and heavier components, a second liquid stream containing $C_3$ and heavier components, a residue gas stream, and a refrigerant stream to produce a cooled gas stream;

b) passing the cooled gas stream to a first separator to produce a first separator gas stream and a first separator liquid stream;

c) optionally further cooling the first separator gas stream by heat exchange or expansion and passing it to a separator/absorber wherein the second liquid stream is produced as a bottoms stream and wherein a separator/absorber overhead residue gas stream is produced;

d) passing the first separator liquid stream to a second separator at a lower pressure than the first separator and separating a second separator residue gas stream and a second separator liquid stream;

e) passing the first separator liquid stream and the second separator liquid stream to a deethanizer tower operating at a pressure at least 25 psi above the separator/absorber pressure;

f) separating the first and the second separator liquid streams into a deethanizer bottoms stream containing a majority of the $C_3$ and heavier components and a deethanizer overhead gas stream;

g) cooling the deethanizer overhead gas stream to partially condense the deethanizer overhead gas stream by heat exchange with a refrigerant stream to produce a deethanizer liquid reflux stream, a third liquid stream and a deethanizer residue gas stream; and, j) cooling the third liquid stream by heat exchange with the separator/absorber overhead residue gas stream to produce a subcooled third liquid stream and passing the subcooled third liquid stream into an upper portion of the separator/absorber.

16. The process of claim 15 wherein the refrigerant comprises propane.

17. The process of claim 15 wherein the pressure of the deethanizer is at least 100 psi greater than the pressure in the separator/absorber.

18. The process of claim 15 wherein the pressure in the deethanizer is at least 200 psi greater than the pressure in the separator/absorber.

19. The process of claim 15 wherein the separator/absorber contains at least one theoretical stage of mass transfer.

* * * * *